United States Patent [19]

Dessau

[11] 4,022,588

[45] May 10, 1977

[54] OXIDATIVE CHEMICAL REMOVAL OF PYRITIC SULFUR FROM COAL BY MANGANESE, VANADIUM, AND CERIUM OXIDANTS

[75] Inventor: Ralph M. Dessau, Edison, N.J.

[73] Assignee: Mobil Oil Corporation, New York, N.Y.

[22] Filed: Mar. 5, 1976

[21] Appl. No.: 664,330

[52] U.S. Cl. ..... 44/1 R; 201/17
[51] Int. Cl.[2] ..... C10L 9/10; C10B 57/00
[58] Field of Search ..... 44/1 R; 201/17

[56] References Cited

UNITED STATES PATENTS

| | | | |
|---|---|---|---|
| 3,756,791 | 9/1973 | Mancke | 44/1 R |
| 3,909,213 | 9/1975 | Sanders | 44/1 R |
| 3,926,575 | 12/1975 | Meyers | 44/1 R |

*Primary Examiner*—Carl F. Dees
*Attorney, Agent, or Firm*—Charles A. Huggett; Carl D. Farnsworth

[57] ABSTRACT

A process is disclosed in which pyritic sulfur in coals is removed by treatment with aqueous solutions containing manganese, vanadium and cerium metal oxidants.

6 Claims, No Drawings

OXIDATIVE CHEMICAL REMOVAL OF PYRITIC SULFUR FROM COAL BY MANGANESE, VANADIUM, AND CERIUM OXIDANTS

BACKGROUND OF THE INVENTION

This invention generally relates to the desulfurization of carbonaceous materials containing pyritic sulfur and specifically relates to the desulfurization of coal and solid coal derivatives containing pyritic sulfur through the use of manganese, vanadium, and cerium oxidants in an aqueous acidic medium.

The present use of coal in the United States is primarily for the purpose of conversion into electrical energy and thermal generating plants. A principal drawback in the use of coal on a more widespread basis is its sulfur content, which can range up to 5 percent. The removal of sulfur from any liquid or solid fossil fuel improves the fuel for use in energy release by oxidation without pollution. Furthermore, the removal of sulfur from coal and solid coal derivatives permits more efficient use of coal in producing liquid fuels and feedstocks, in gasification processes, and in metallurgical processing.

In recent years, air and water pollution resulting from mining and burning of coal has come under public scrutiny. Earlier concern was over the smoke produced from coal-burning installations. Efforts were directed toward more complete combustion in power plants, development of processes for smokeless fuel for domestic use, and reduction of dust effluent from chimneys. More recently, sulfur in coals and rocks overlying coalbeds has received wide attention as a major cause of air and water pollution. In recent years, for example, 209 million tons of coal containing an average of 2.5 percent sulfur was burned in the United States; the sulfur discharged to the atmosphere, mainly as sulfur dioxide, amounted to about 5 million tons. Considering the subsequent increase in power demand which will continue into the foreseeable future, the seriousness of the problem is impressive. Accordingly, both State and Federal Governments have enacted legislation and promulgated regulations which place upper limits on the sulfur content of coals to be burned or on the sulfur dioxide content of the discharged flue gas. However, additional processing of coal, either by processing the coal before it is burned or by processing the flue gas after the coal is burned, adds to the cost of products derived from it — electricity, for example. Thus, the problem of pollution caused by the combustion of coal or coal-derived fuels affects utilization of coal as a source of power and, hence, its value as a natural resource. Therefore, the cost of removing sulfur from coal must be kept reasonably low, so that coal may be efficiently and economically used as an alternative energy source.

The sulfur in coal occurs in three forms: (1) pyritic sulfur in the form of pyrite or marcasite, (2) organic sulfur, and (3) sulfate sulfur. However, the primary sulfur contaminants are of the first two forms. One solution to the coal desulfurization problem is the removal of sulfur dioxide from flue gas generated by combustion of the coal; another is the removal of sulfur before the coal is combusted or otherwise used. The present invention is a solution of the latter type, and is more specifically described as the chemical removal of inorganic sulfur, especially pyritic sulfur, under relatively mild reaction conditions.

Description of the Prior Art

The use of manganese oxide to desulfurize coal and coal products has long been known in the art. However, these prior processes may be characterized as high-temperature volatilization processes as opposed to oxidative solubilization processes. For example, U.S. Pat. No. 28,543 (issued in 1860) discloses a process for the removal of sulfur after the coking process, wherein a mixture of sodium chloride, manganese peroxide, resin, and water is applied to the red-hot coke, and sulfur is oxidized and released from the coke mass in gaseous form. Other similar processes are disclosed in U.S. Pat. Nos. 90,677, 936,211, 3,348,932, and 3,635,695.

The use of oxidative solubilization processes to remove sulfur from coal is a relatively new concept. Even though the solubilization of pyrites by various oxidizing agents, including nitric acid, hydrogen peroxide, hypochlorite, ferric and cupric ions, has long been known, the application of these reactions to the removal of pyrite from coal has only recently been reported. The success of such processes in a coal medium was unexpected because pyrite is dispersed in finely divided form throughout the coal matrix, and the penetration of such an organic matrix with water is known to be difficult. Furthermore, the oxidative dissolution of pyrites from the coal matrix with strong aqueous oxidizing agents, such as nitric acid, hydrogen peroxide, or hypochlorite extensively oxidize the organic coal matrix. Moreover, the use of such strong oxidizing agents will convert the sulfur content of the coal to sulfate but not to free sulfur which is obviously a more valuable commodity than sulfate.

The application of mild oxidation reactions to remove the pyrite from coal is disclosed in U.S. Pat. No. 3,768,988. The process of that invention employs the ferric ion as the oxidizing agent and will hereinafter be referred to as the Meyers process. Essentially, the Meyers process employs aqueous ferric sulfate or chloride to oxidize the pyritic sulfur to elemental fulfur. About 60 percent of the pyritic sulfur content of the coal is oxidized to the sulfate which dissolves in the aqueous leaching solution. The free sulfate is then removed from the coal matrix by solvent extraction with an organic sulfur solvent such as benzene, kerosene, p-cresol, etc., or by steam or vacuum vaporization. The aqueous oxidizing agent is regenerated and recycled to the oxidation step. The Meyers process may be represented as follows:

1. Leaching: $2\ Fe^{+3} + FeS_2 . Coal \rightarrow 3\ Fe^{+2} + 2\ S . Coal$
2. Sulfur Recovery: $S . Coal \rightarrow S\ (elemental) + Coal$
3. Regeneration: $3\ Fe^{+2} + 3/4\ O_2 \rightarrow 3\ Fe^{+3} + 3/2\ [O=]$

SUMMARY OF THE INVENTION AND DESCRIPTION OF PREFERRED EMBODIMENTS

It is an object of this invention to provide a process for the reduction of sulfur, particularly pyritic sulfur, in coal.

Another object of this invention is to provide a process which offers flexibility in producing elemental sulfur while reducing the sulfur content of coal.

Other objects of this invention will become apparent from the description which follows.

The term "coal", as used herein, is to be liberally interpreted, and in its broadest aspect is to include any carbonaceous material containing substantial amounts of pyritic sulfur. Thus, the term may include materials such as anthracite coal, bituminous coal, sub-bituminous coal, lignite, plat, coke, petroleum coke, or coke breeze. The term pyritic sulfur is known in the art and refers to sulfur bound in chemical combination with iron in the coal in the form of iron pyrites which may be designated by the formula $FeS_x$, wherein x is an integer or fraction from about 0.5 to about 4.

According to the invention, the sulfur content of coal is reduced by an oxidative solubilization process wherein the pyritic sulfur contained in coal is reacted with an aqueous solution containing an effective amount of a manganese, vanadium, or cerium metal oxidant. The reacted coal is then separated from the solution and the elemental sulfur which remains trapped within the coal matrix is removed by known processes, such as those used and described above in the Meyers process.

The manganese, vanadium and cerium metal oxidants used are known materials conventionally employed in the art as oxidants. In general, it may be stated that the oxidants are those metal compounds which have a metal ion existing in an oxidation state higher than the lowest oxidation state of the metal ion. The oxidants are further characterized as being water soluble or capable of being solubilized in acid aqueous solution. Exemplary metal oxidants include manganic naphthenate, soluble manganese dioxide, manganic stearate, manganic oleate, manganic fluoride; vanadium compounds such as vanadium pentoxide, sodium vanadate, ammonium metavanadate, vanadium pentoxide, and cerium compounds such as ceric ammonium nitrate, ceric sulfate, etc. The preferred metal oxidants are the higher valent compounds of vanadium, manganese and cerium such as manganese dioxide, ammonium metavanadate, and ceric ammonium nitrate.

The amount of metal oxidant utilized should be at least a stoichiometric mole ratio of oxidant to the pyritic sulfur content of the coal. Amounts less than stoichiometric can be used but are not preferred. In general, a stoichiometric excess is utilized in mole ratios of 5:1 or higher. On a weight basis, the concentration of metal oxidant ranges from about 0.5 to 5.0%.

The coal, prior to reaction with the aqueous solution containing the metal oxidant, is preferably prepared by grinding so that it will have a particle size less than 1/2 mesh. The suitably prepared coal is then reacted in an aqueous solution which contains an effective amount of metal oxidant.

In a typical embodiment, the coal is wet ground to a finely divided state through the use of a ball mill, rod mill, or hammer mill, etc., to a particle size of about 10 to 100 mesh. Water is then added in an amount sufficient to provide an aqueous slurry having a solids content of 1 to 20%. The aqueous solution is preferably acidified to a pH of about 1 to 5 through the use of a mineral acid such a sulfuric acid, hydrochloric acid, or the like. Thereafter the aqueous solution is reacted with the metal oxidant under reflux conditions at 100° C. The reflux time is not critical and may vary from 4 to 16 hours.

Upon completion of the reaction, the aqueous solution will contain ferrous sulfate and ferric sulfate as a result of oxidizing the pyritic sulfur in the coal. In most instances, essentially all of the pyritic sulfur is removed from the coal whereas free elemental sulfur remains in the coal. The aqueous oxidizing solution is separated from the coal and the treated coal is thereafter purified by known methods of washing or extraction to remove the free sulfur.

The aqueous oxidizing solution which is separated from the coal may be regenerated by methods well known in the art. Such processes include the use of air, oxygen, peroxides, or electrolytic systems to regenerate the manganese, vanadium, or cerium salt to the higher oxidation state of the metal. Alternatively, oxygen regenerative of the oxidant may be accomplished by a process wherein the oxidizing solution is continuously refluxed in a moving coal bed, and oxygen is injected into the refluxing medium. The reacted coal and a portion of the oxidizing solution are continuously withdrawn from the process and the elemental sulfur which remains trapped within the coal matrix is removed and further treated as described.

If a vanadium salt is used in the oxidizing solution for reaction with pyritic sulfur, it may be desirable to use a "Stretford-type" process to regenerate the oxidizing solution by oxidation of the pyritic sulfur by a higher-valent vanadium ion, which, in turn, is regenerated by air via soluble quinones. This type process is described A. J. Moyes and J. S. Wilkinson in The Chemical Engineer, 84 (1974), and another by C. Ryder and A. V. Smith in the I.G.E. Journal, 283 (1963).

The following examples illustrate the best mode now contemplated for carrying out the invention.

Table 1 shows the sulfur content reduction of a medium volatile coal treated by refluxing the coal in an aqueous, acidic solution (0.5 M $H_2SO_4$) containing various manganese, vanadium, and cerium oxidants according to the process of this invention. A comparison with ferric sulfate oxidizing agent is also shown.

TABLE 1

Removal of Pyritic Sulfur by Metal Oxidants

| | Millimoles oxidant per gram of coal | Reflux (100° C) time (hrs.) | Wt. % Pyritic Sulfur | Wt. % Sulfate Sulfur | Wt. % Organic Sulfur | Wt. % Elemental Sulfur[1] | Wt. % Total Sulfur | |
|---|---|---|---|---|---|---|---|---|
| Medium Volatile Bituminous Coal | — | — | 2.92 | 0.33 | 0.61 | 0 | 3.86 | |
| Control Run, $H_2SO_4$ only | — | 16 | 2.98 | | | | 3.51 | |
| Oxidant | | | | | | | | |
| $MnF_3$ | 9 | 16 | 0.52 | | | | 2.00 | |
| $MnO_2$ (soluble) | 9 | 16 | 0.19 | 0.29 | 1.30[2] | 0.69 | 1.78 | (1.56)[3] |
| $MnO_2$ | 1.8 | 16 | 0.02 | | | | 3.07 | (2.43)[3] |
| $VO(OAc)_2$ | 3 | 16 | 2.94 | | | | 3.87 | |
| $Na_3VO_4$ | 4 | 16 | 1.83 | | | | 2.98 | (2.57)[3] |
| $Na_3VO_4$ | 2.7 | 16 | 1.77 | 0.09 | 0.97 | 0.36 | 2.83 | |
| $Na_3VO_4$ in $Na_2CO_3$ | 2.7 | 16 | 1.97 | 0.05 | 1.21 | 0.60 | 3.23 | |
| $V_2O_5$ | 5 | 16 | 1.50 | | | | 1.94 | |
| $V_2O_5$ | 10 | 16 | 1.50 | | | | 1.94 | |

TABLE 1-continued

Removal of Pyritic Sulfur by Metal Oxidants

| | Millimoles oxidant per gram of coal | Reflux (100° C) time (hrs.) | Wt. % Pyritic Sulfur | Wt. % Sulfate Sulfur | Wt. % Organic Sulfur | Wt. % Elemental Sulfur[1] | Wt. % Total Sulfur |
|---|---|---|---|---|---|---|---|
| $NH_4VO_3$ | 10 | 16 | 0.04 | | | | 1.80 |
| $NH_4VO_3$ | 10 | 4 | 0.26 | 0.11 | 1.46 | 0.85 | 1.83 |
| $NH_4VO_3$ | 2 | 16 | | 0.15 | 1.12 | 0.51 | 2.92 |
| $Ce(NH_4)_2(NO_3)_6$ | 1 | 16 | 0.02 | | | | 1.37 |
| $Fe_2SO_4$ | 18 | 16 | 0.02 | 0.20 | 2.12[2] | 1.51 | 2.34 |
| $Fe_2SO_4$ | 3.6 | 16 | 0.02 | 0.13 | 2.23[2] | 1.62 | 2.38 |

[1]Calculated as difference between initial organic sulfur content and analyzed value.
[2]High value implies free sulfur formation
[3]After washing once with $CS_2$ at room temperature It will be noted that the oxidizing agents employed in the preferred embodiment of this invention — $MnO_2$, $NH_4VO_3$, and $Ce(NH_4)_2(NO_3)_6$ — convert essentially 100% of the pyritic sulfur contained in the coal. In such examples, considerable amounts of free elemental sulfur, formed as the initial product in the oxidation of pyritic, remained in the coal. However, washing the coal once wwith $CS_2$ at room temperature removed 20–30% of this free sulfur. Furthermore, the data obtained with $MnO_2$ at two different dosage rates (9 and 1.8 millimoles $MnO_2$ per gram of coal) demonstrate that the amount of free sulfur formed in the oxidative solubilization process of this invention may be controlled by the amount of oxidizing agent employed in the process. By using less oxidant, pyrite sulfur is effectively converted to elemental sulfur. In contrast to the Meyers process, flexibility is provided in maximizing either the production of sulfate or free sulfur.

The process of this invention is efficient in that essentially all of the pyritic sulfur contained in the coal matrix may be removed or converted to elemental or free sulfur which may be removed from the coal by known methods, such as vaporization or extraction techniques. Additionally, the process is selective in that the amount of pyritic sulfur converted to free sulfur may be controlled by varying the amount of oxidizing agent in the oxidizing solution. Furthermore, the process is simple because no high temperatures, pressures, or catalysts are required. Finally, the oxidizing solution of this invention does not produce any substantial interaction with the coal matrix, permitting substantially all of the coal treated to be utilized as low sulfur fuel.

What is claimed is:

1. In an oxidative solubilization process for reducing the pyritic sulfur content of coal wherein coal is reacted with an aqueous solution of metal oxidant and a coal product having a reduced content of pyritic sulfur is thereafter recovered, the improvement which comprises using a metal oxidant selected from the group consisting of manganese, vanadium and cerium oxidants.

2. The process of claim 1, wherein the aqueous solution is acidified and has a pH in the range of 1 to about 5.

3. The process of claim 2, wherein the metal oxidant is a higher valent compound of manganese, vanadium or cerium.

4. The process of claim 2, wherein the metal oxidant is soluble manganese dioxide.

5. The process of claim 2, wherein the metal oxidant is ammonium vanadate.

6. The process of claim 2, wherein the metal oxidant is ceric ammonium nitrate.

* * * * *